US006471204B1

(12) United States Patent
Tamaki

(10) Patent No.: US 6,471,204 B1
(45) Date of Patent: Oct. 29, 2002

(54) IMAGE RECORDING APPARATUS

(75) Inventor: Hiroyuki Tamaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/593,422

(22) Filed: Jun. 14, 2000

(30) Foreign Application Priority Data

Jun. 17, 1999 (JP) ..... 11-171092

(51) Int. Cl.[7] ..... B65H 43/00
(52) U.S. Cl. ..... 271/176; 271/189; 271/258.01
(58) Field of Search ..... 271/176, 306, 271/182, 189, 192, 265.01, 258.01, 258.03, 258.04, 218

(56) References Cited

U.S. PATENT DOCUMENTS 4,207,788 A * 6/1980 Regele ..... 271/192
4,469,321 A * 9/1984 Geschwindner ..... 271/189
4,844,633 A * 7/1989 Greenberg ..... 271/189
5,536,000 A * 7/1996 Kelly ..... 271/189
5,823,529 A * 10/1998 Mandel et al. ..... 271/176
6,113,094 A * 9/2000 Horiguchi et al. ..... 271/176

FOREIGN PATENT DOCUMENTS

JP 360052440 A * 3/1985 ..... 271/258.01
JP 0215434 * 9/1987 ..... 271/176

* cited by examiner

*Primary Examiner*—H. Grant Skaggs
(74) *Attorney, Agent, or Firm*—Fitzpatrick, Cella, Harper & Scinto

(57) ABSTRACT

In an image recording apparatus with excellent quality which can prevent image degradation and the like due to stacking too much recording material on a discharge tray, when the recording operation is carried out, a sensor measures the distance from the upper surface of a flapper to the stacked object. The output obtained here is taken in by a distance detecting circuit. After a calculation circuit carries out comparison and calculation, the distance is calculated and is transmitted to a control circuit. By comparing the calculated distance with thickness data with regard to the recording material and the like stored in advance in a memory device in the control circuit, the allowable residual amount of stack and the allowable residual number of sheets of stack are further presumed.

23 Claims, 11 Drawing Sheets

IMAGE RECORDING APPARATUS

BACKGROUND OF THE INVENTION

1. Field of the Invention

The present invention relates to an image recording apparatus with functions to record an image on a recording material and to discharge the recording material after recording onto a discharge tray.

2. Related Background Art

Conventionally, image recording apparatus of this kind include image recording apparatus having the functions as a printer, a copying machine, a facsimile machine, and the like and image recording apparatus used as an output apparatus of a composite electronic apparatus including a computer (hereinafter abbreviated as PC) and a word processor, a workstation, and the like.

These image recording apparatus are structured to record an image (including a letter and a symbol) on a recording material such as paper and a plastic thin plate according to recording information.

Recently, such recording apparatus have replaced conventional dot matrix printers and laser beam printers (hereinafter abbreviated as LBPs), ink-jet printers (hereinafter abbreviated as IJPs), thermal printers, and the like have been put to practical use.

Today, LBPs which can carry out tone reproduction with high resolution and high quality, and IJPs which can carry out full color reproduction with photographic image quality are put to practical use.

As the performance of the recording apparatus bodies becomes higher and higher, in order to fully draw out the printing performance of the image recording apparatus, high quality recording media such as glossy paper, glossy films, coated paper and even media dedicated for photographic images are put to practical use.

Therefore, the image recording apparatus bodies are required to be able to record on various kinds of recording media, and together with this, the recording speed of IJPs are required to be comparable to that of LBPs.

The faster recording operation makes shorter the time period until the next recording material is discharged. However, with regard to IJPs, though improvement of ink is in progress, it still takes time to dry the ink.

In this case, a problem arises that the image is degraded if the next recording material is laid on top of the present recording material while the present recording material remains undried.

In particular, in an office, it is often the case that one image recording apparatus is shared by multiple hosts in a network environment. Though ASFs and paper feed cassettes are provided with a mechanism with which a large amount of recording paper can be stored, a recording material after recording is rapidly stacked up at the sheet discharge portion, and the above-mentioned problem is liable to occur.

In order to solve the problem, an apparatus is put to practical use in which a sheet discharge assist plate (hereinafter referred to as a flapper) as an auxiliary retaining member is provided on a sheet discharge tray (discharge tray) of the sheet discharge portion, and a mechanism is mounted which prevents a recording material now being recorded from coming in contact with the recording material which was discharged immediately before the recording material now being recorded at least during the recording operation to gain drying time.

Such an apparatus provided with a flapper is described in the following with reference to FIGS. 9 to 11.

FIG. 9 is a schematic perspective view of an image recording apparatus according to conventional art. FIGS. 10 and 11 are explanatory views of its operation.

In FIG. 9, reference numerals 1, 2, 3, 4, and 5 denote an image recording apparatus body, a sheet feeding device, a recording material, a sheet discharge tray as a discharge tray, and a flapper as an auxiliary retaining member, respectively.

In FIG. 10, the recording material 3 is conveyed in the direction indicated by an arrow a in the figure as an image is recorded thereon by a recording portion which is not shown.

In FIG. 11, when the recording operation ends, by driving the flapper 5 in the directions indicated by arrows b and c in the figure by power from a motor for conveyance or the like which is not shown, the recording material 3 which is discharged after the recording operation and is on the flapper 5 is made to drop in the direction indicated by an arrow d to be stacked on the sheet discharge tray 4.

After that, the flapper 5 is returned to the initial position by operating the flapper 5 in the directions opposite to those indicated by the arrows b and c, and the flapper 5 is ready for the next recording operation.

However, the conventional apparatus described in the above has the following problems.

Since the above-described flapper 5 is structured to be movable over the right and left upper ends of the recording material which is discharged and stacked up, the movable range of the flapper is restricted when the amount of stack of the recording material after discharge becomes large.

FIG. 12 illustrates that the discharged recording material reaches a predetermined value of the amount of stack (the maximum amount of stack).

As can be seen from the figure, if too much recording material is stacked up, the flapper 5 comes in contact with the uppermost recording material, and thus, the operation of the flapper 5 is restricted.

Since the flapper 5 comes in contact with the recording material, not only an image recorded on the recording material is damaged and degraded, but also the operation of the flapper 5 is hindered and the driving system of the flapper 5 is adversely affected.

Further, in case the driving system for driving the flapper 5 branches off from the conveyance driving system for conveying the recording material, the conveyance driving system may also be hindered, and thus it may cause improper discharge.

Though the apparatus body provides a predetermined value as the sheet discharge capacity to draw a user's attention, particularly in a network environment, it is difficult to give a recording command after confirming the state of sheet discharge of the apparatus body.

SUMMARY OF THE INVENTION

The present invention is made to solve the problems of the conventional art described in the above, and an object of the present invention is to provide an image recording apparatus with excellent quality which can prevent image degradation and the like due to stacking too much recording material on a discharge tray.

In order to attain the above object, according to an aspect of the present invention, an image recording apparatus comprising recording means for recording an image on a recording material and an auxiliary retaining member for temporarily retaining the recording material after an image is recorded thereon by the recording means and for dropping the recording material onto a discharge tray to stack the recording material is further provided with detecting means for detecting the amount of stack of the recording material on the discharge tray.

Accordingly, whether the amount of stack of the recording material on the discharge tray is a hindrance or not can be known.

The detecting means preferably has a sensor for measuring the distance from a predetermined position to the surface of the uppermost stacked recording material.

The sensor is preferably provided on the auxiliary retaining member.

The detecting means may have a rotating member one end thereof being pivotally supported and the other end thereof being freely in contact with the uppermost stacked recording material, and detecting means for detecting the rotational angle of the rotating member.

According to another aspect of the present invention, an image recording apparatus comprising recording means for recording an image on a recording material and an auxiliary retaining member for temporarily retaining the recording material after an image is recorded thereon by the recording means and for dropping the recording material onto a discharge tray to stack the recording material is further provided with detecting means for detecting whether the amount of stack of the recording material on the discharge tray reaches a predetermined amount or not.

Accordingly, whether the amount of stack of the recording material on the discharge tray reaches a hindering amount or not can be known.

The detecting means preferably has a switch which comes in contact with the surface of the uppermost stacked recording material when the amount of stack of the recording material reaches a predetermined amount.

The result of the detection by the detecting means is preferably transmitted to a control portion of the apparatus body or to an external device.

The result of the detection by the detecting means is preferably indicated on an indicating portion of the apparatus body or on an indicating portion of an external device.

Presuming means is preferably provided for presuming, based on the amount of stack of the recording material detected by the detecting means, the allowable residual amount of stack relative to the maximum amount of stack of the recording material which does not hinder the operation of the auxiliary retaining member.

The presuming means preferably also presumes the allowable residual number of sheets of stack by comparing the thickness of the recording material on which an image is recorded with the allowable residual amount of stack.

The thickness of the recording material is preferably based on information registered in advance according to the kind of the recording material.

The result of the presumption by the presuming means is preferably indicated on an indicating portion of the apparatus body or on an indicating portion of an external device.

The image recording operation is preferably not carried out when it is judged that there is no allowable residual amount of stack as a result of the presumption by the presuming means.

The auxiliary retaining member preferably comprises opening and closing members provided at both ends, respectively, of the discharge tray in the width direction so as to be freely opened and closed, and retains the recording material with the opening and closing members in a closed state and drops the recording material onto the discharge tray by opening the opening and closing members.

A retaining surface where the recording material is retained by the opening and closing members is preferably substantially flush with a discharging surface where the recording material after image recording is discharged.

A driving source for opening and closing the opening and closing members may also serve as a driving source for conveying the recording material.

The time period during which the recording material after image recording is temporarily retained by the auxiliary retaining member is preferably established such that degradation of a recorded image does not occur between a dropped recording material and the uppermost stacked recording material which is already stacked on the discharge tray.

DESCRIPTION OF THE PREFERRED EMBODIMENTS

Preferred embodiments of the present invention are now described in detail by way of example with reference to the drawings. However, it is to be noted that any size, material, shape, the relative position, and the like of the components described in the embodiments shall not restrict the scope of the invention thereto unless specifically stated herein.

[Embodiment 1]

An image recording apparatus according to a first embodiment is now described with reference to FIGS. 1 to 5.

It is to be noted that, in the present embodiment described in the following, an ink-jet printer using the ink-jet method as the recording means is described as an example of an image recording apparatus.

Figure 1:
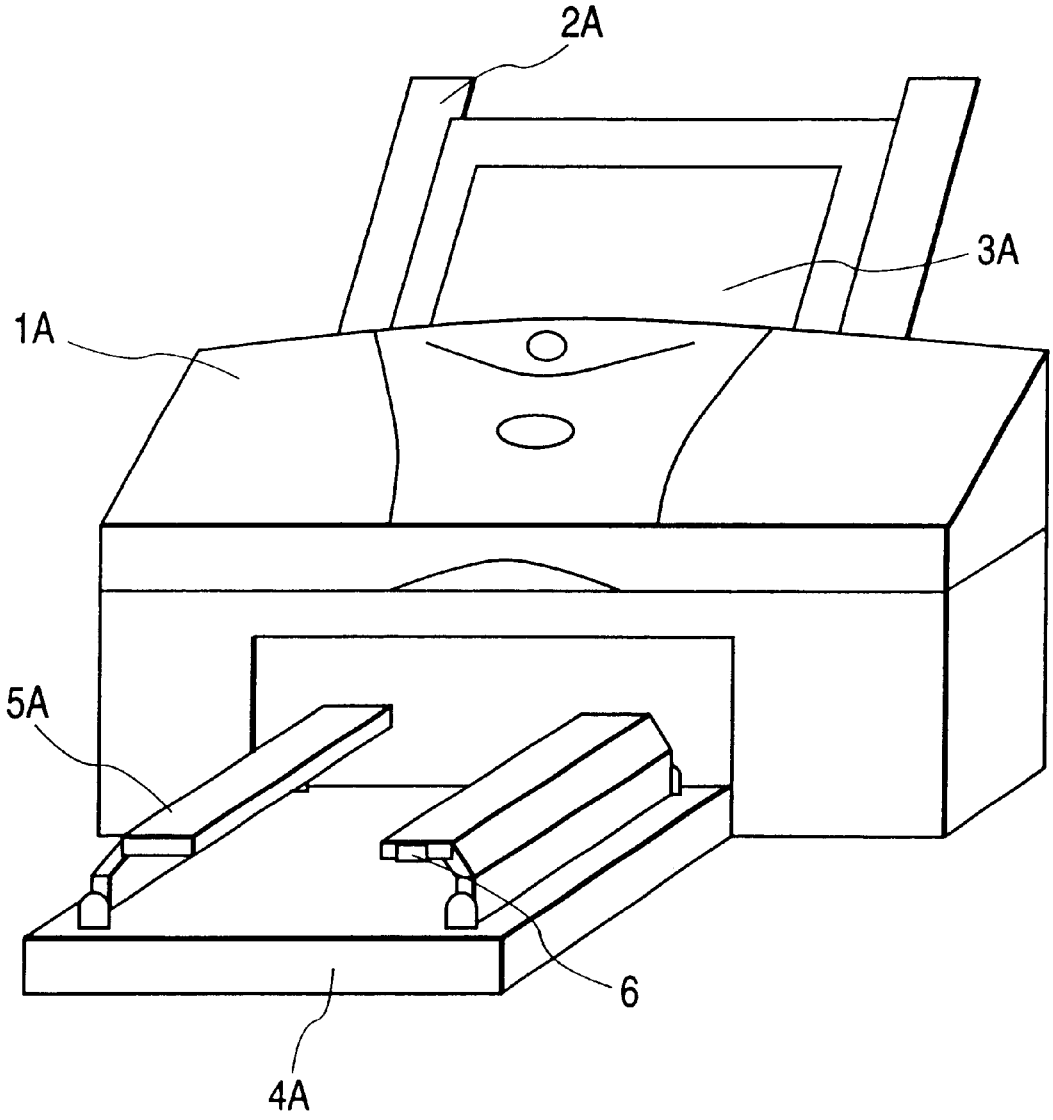
FIG. 1 is a schematic perspective view of an image recording apparatus according to a first embodiment of the present invention.
Figure 2:
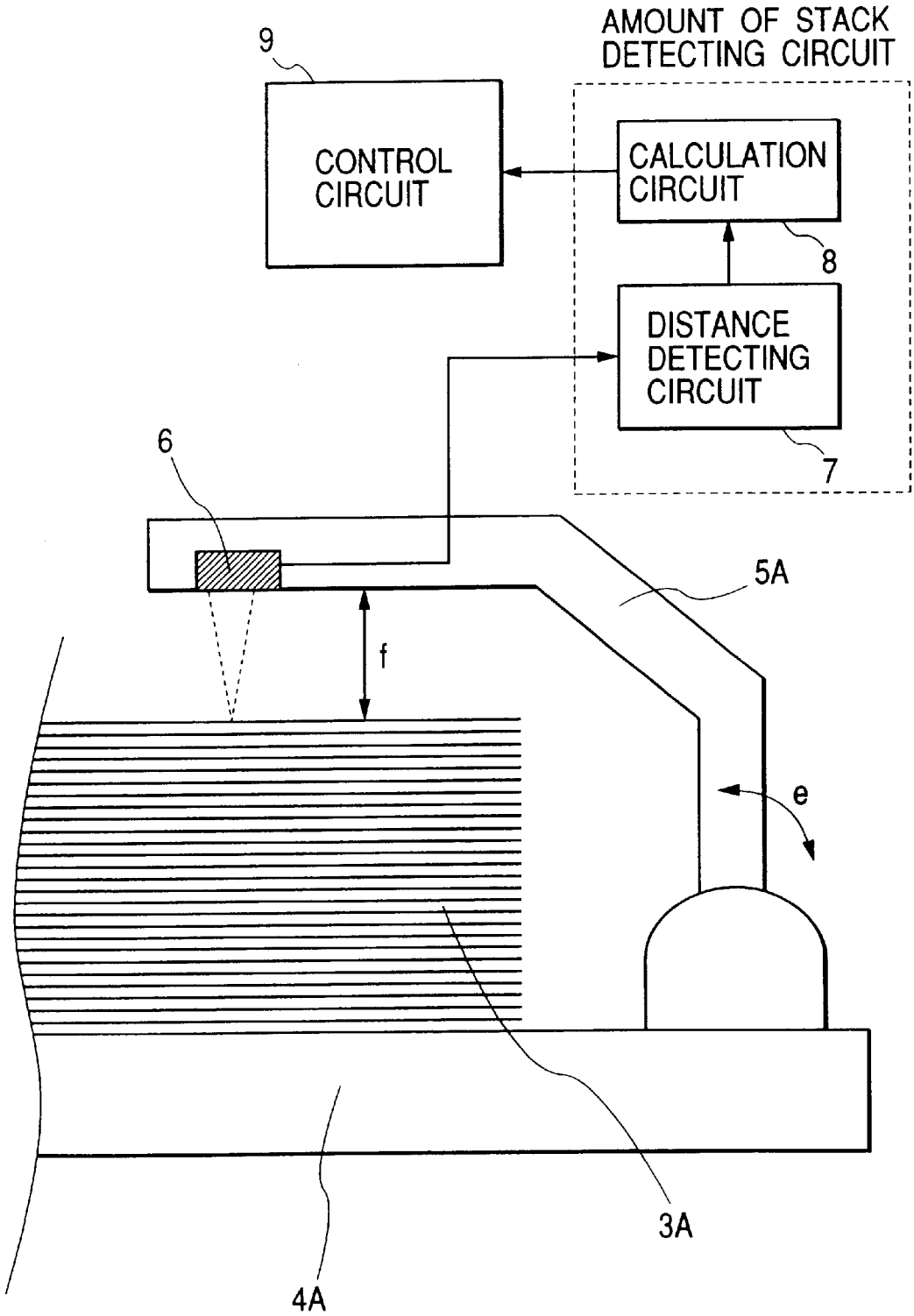
FIG. 2 is an explanatory view of the operation of a discharge portion for a recording material in the image recording apparatus according to the first embodiment of the present invention.

FIG. 1 is a schematic perspective view of an image recording apparatus according to a first embodiment of the present invention. FIG. 2 is an explanatory view of the operation of a discharge portion for a recording material in the image recording apparatus according to the first embodiment of the present invention (a front view of a flapper and an explanatory view corresponding to a mechanism portion for measuring a dischargeable residual amount of the recording material).

Figure 10:
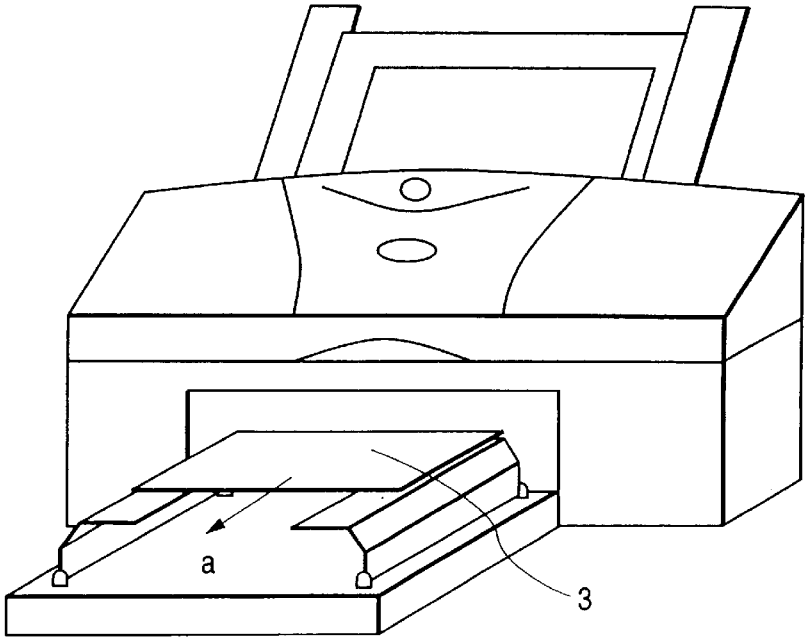
FIG. 10 is an explanatory view of the operation of the image recording apparatus according to the conventional art.
Figure 11:
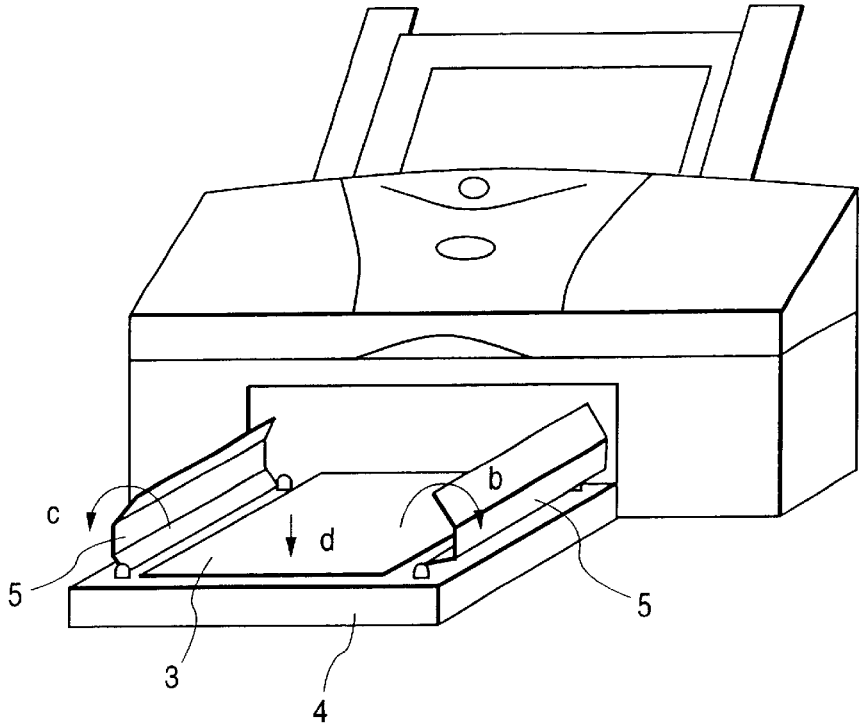
FIG. 11 is an explanatory view of the operation of the image recording apparatus according to the conventional art.
Figure 12:
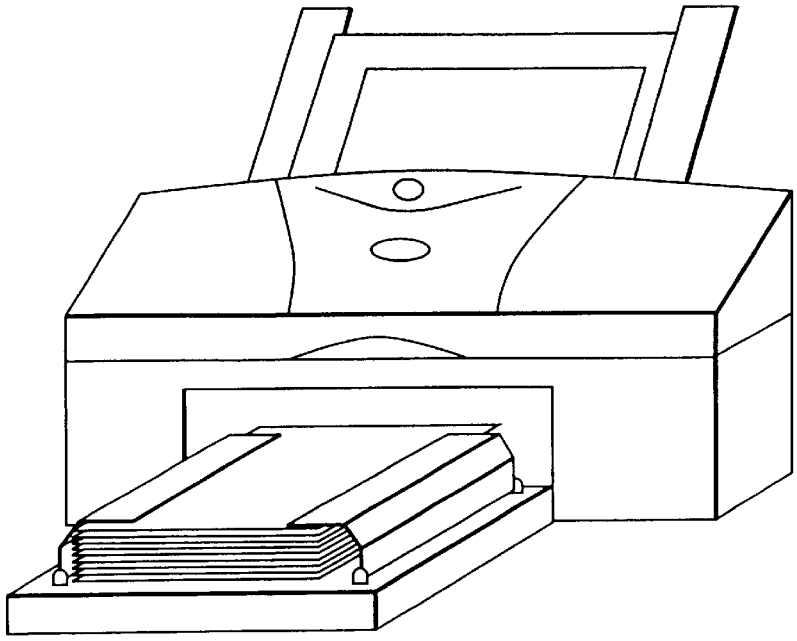
FIG. 12 illustrates that the discharged recording material reaches a predetermined value of the amount of stack (the maximum sheet stack capacity).

In FIGS. 1 and 2, reference numerals 3A, 4A, and 5A denote a recording material, a sheet discharge tray as a discharge tray, and a flapper as an opening and closing member which functions as an auxiliary retaining member, respectively. The flapper 5A is movable in the same direction as shown in FIG. 10, that is, in the direction indicated by an arrow e in FIG. 2. The stacking operation of the recording material onto the discharge tray is similar to the operation described with reference to FIG. 10 and the like in the above RELATED BACKGROUND ART section, and thus, detailed description thereof is omitted.

It is to be noted that the upper surface of the flapper 5A is a retaining surface on which the recording material is retained. By making the retaining surface substantially flush with a discharging surface of the recording material 3A after image recording, a step can be eliminated to avoid degradation of the recorded image.

By establishing the time period during which the recording material 3A is temporarily retained by the flapper 5A such that, when the retained recording material is dropped, degradation of a recorded image does not occur between the dropped recording material and the uppermost stacked recording material, that is, by establishing the time period so as to be long enough for the ink to dry, the image quality can be maintained.

A sensor 6 which mainly forms detecting means used to measure the distance to the stack surface is provided at an upper portion of the flapper 5A.

Reference numerals 7, 8, and 9 denote a detecting circuit, a calculation circuit and a control circuit of the image recording apparatus, respectively. The detecting circuit 7 and the calculation circuit 8 together function as an amount of stack detecting circuit. The control circuit 9 of the image recording apparatus functions as presuming means for presuming the residual amount.

It is to be noted that a part of FIG. 2 shows an enlarged view of the front right side of a front view of a sheet discharging portion in FIG. 1.

First, when the recording operation is carried out, the sensor 6 measures a distance f from the upper surface of the flapper 5A to the stacked object.

As the sensor 6, for example, a microdisplacement sensor which can obtain linear voltage output in accordance with the distance, a photomicrosensor which projects light on an object and can obtain voltage in accordance with the reflected light amount, or the like can be used.

The output obtained here is taken in by the distance detecting circuit 7. After the calculation circuit 8 carries out comparison and calculation, the distance f is calculated and is transmitted to the control circuit 9.

A memory device in the control circuit 9 stores in advance thickness data with regard to the recording material and the like. Comparison of these data with the calculated distance f makes it possible to presume not only the allowable residual amount of stack (the residual amount with which the flapper 5A does not interfere with the recording material) but also the allowable residual number of sheets of stack.

Further, by using paper establishment information from a printer driver or the like, a more accurate allowable residual number of sheets of stack can be presumed.

In some cases, it is possible to indicate a notification or a warning on an indicator (indicating portion) or the like provided in a host computer or a printer driver as an external device or provided in the apparatus body to urge the user toward appropriate disposal.

Figure 3:
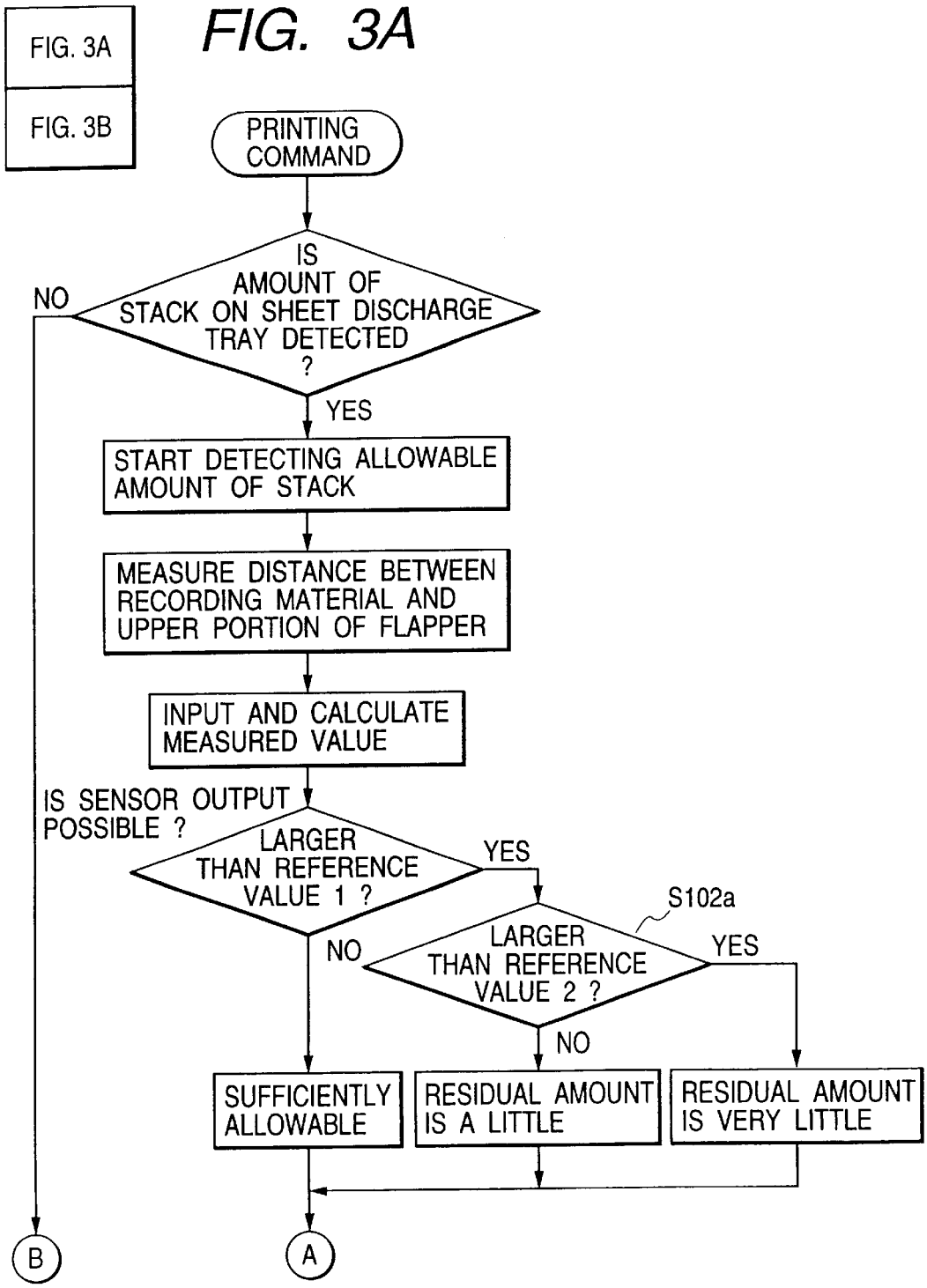
FIG. 3 is comprised of FIGS. 3A and 3B are flowcharts of a printing operation in an ink-jet printer.
Figure 3B:
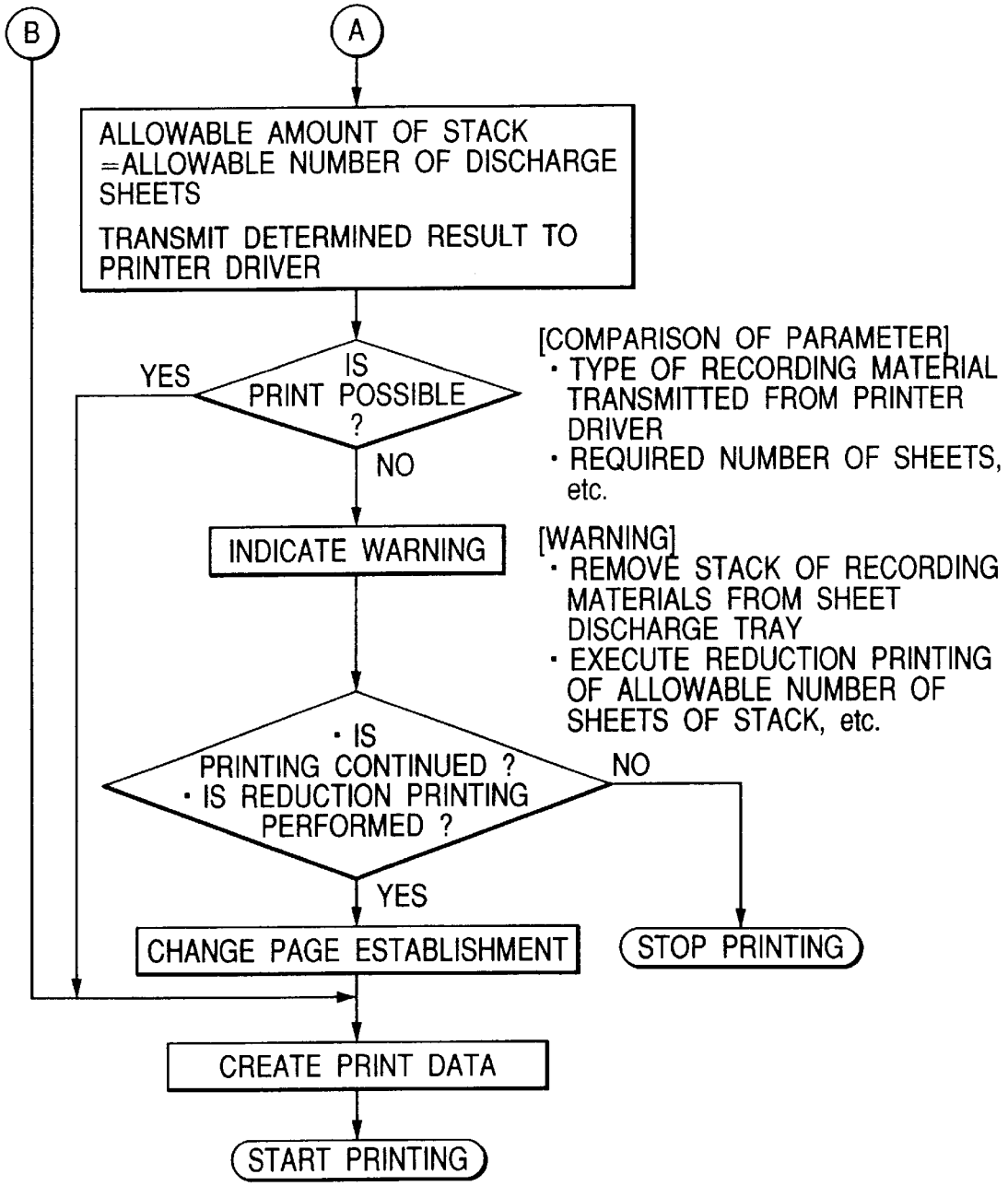
Figure 4:
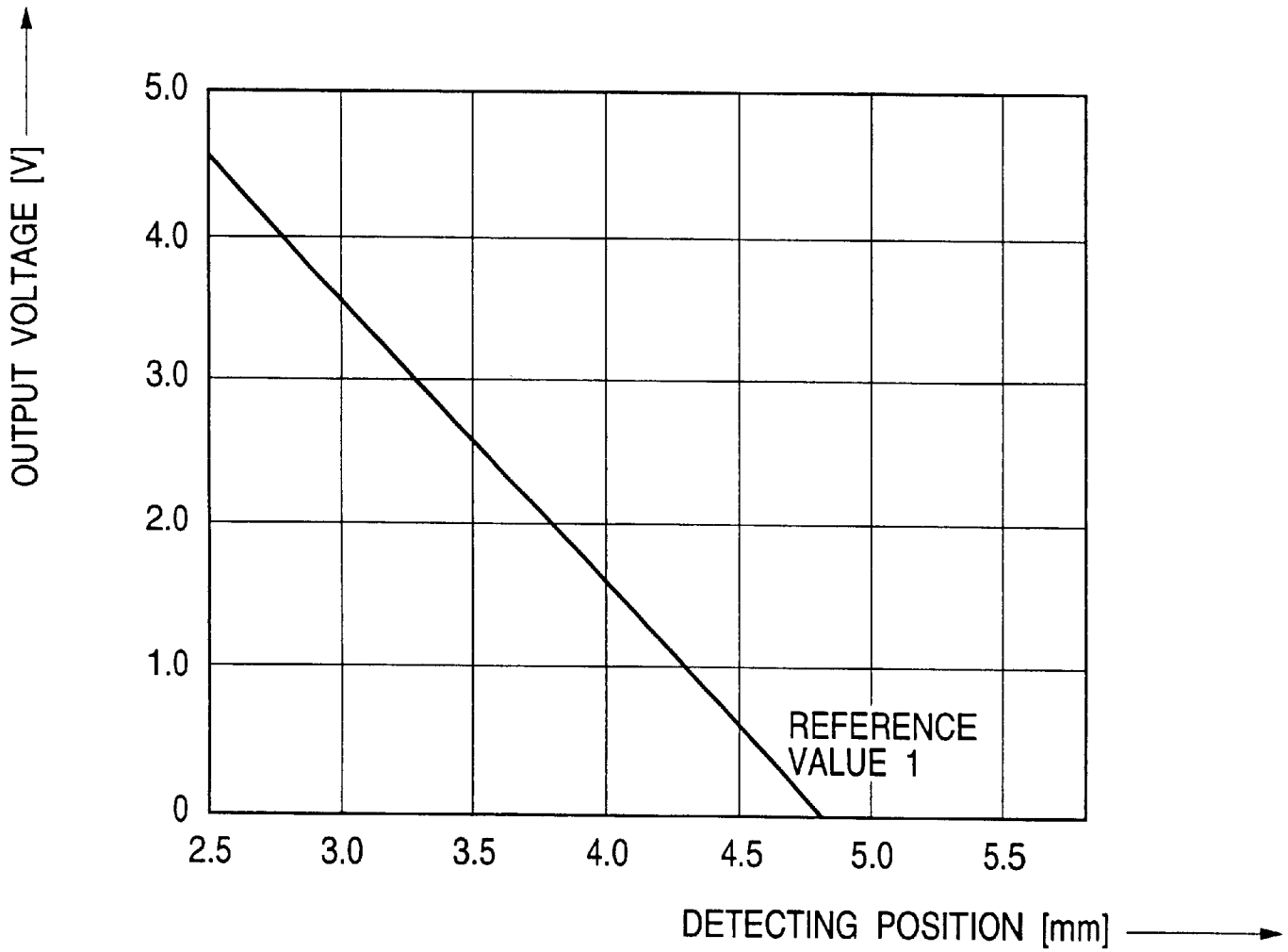
FIG. 4 is a graph showing the detecting position characteristics of a microdisplacement sensor.

FIGS. 3A and 3B are flowcharts of a printing operation in an ink-jet printer as an example. FIG. 4 is a graph showing the detecting position characteristics of a microdisplacement sensor as an example.

First, when a printing command from the side of a host is inputted through an interface portion, the user is urged to judge whether the amount of stack on the sheet discharge tray is to be detected or not.

Here, when the amount of stack is to be detected, measurement of the distance from the surface of the stacked recording material to the sensor 6 provided at the upper portion of the flapper 5A is started.

After the measurement, calculation is carried out to calculate the distance, comparison and determination is carried out according to a reference value, and the dischargeable residual amount or residual number of sheets is presumed.

Here, for the sake of simplicity, the reference values 1 and 2 are used, but of course, a lot of reference values may be provided.

As an example, as shown in FIG. 4, as the detecting position is nearer, the output voltage of the sensor 6 becomes larger.

Here, when the output of the sensor 6 is smaller than the reference value 1 (when the output can not be obtained), it means that the dischargeable residual number of sheets has sufficient room. When the output of the sensor 6 is larger than the reference value 1 (when the output of the sensor can be obtained), the distance f is measured to presume the allowable residual number of sheets of stack.

It is to be noted that reference values 2, 3, 4, . . . may be provided to presume the allowable residual number of sheets of stack at these positions by calculation or by carrying out reading of the memory device.

In this way, the dischargeable residual number of sheets is presumed.

When the dischargeable residual number of sheets is presumed, the determined result is transmitted through the interface portion to the printer driver on the side of the host.

At this time, when the number of sheets established by the printer driver at present is larger than the number of sheets presumed now, a warning is indicated and whether the stacked object is removed or not is confirmed.

Here, when the removal is not carried out, again there is a warning with regard to whether reduction printing is to be carried out within the range of the allowable number of sheets of stack or not to urge the user to change the page establishment.

When all the establishment is completed, the host side generates print information (print data) suitable for the paper, transmits the information through the interface portion to the side of the recording apparatus, and an image is recorded based on the information.

The structure of the control portion is now described with reference to FIG. 5.

Figure 5:
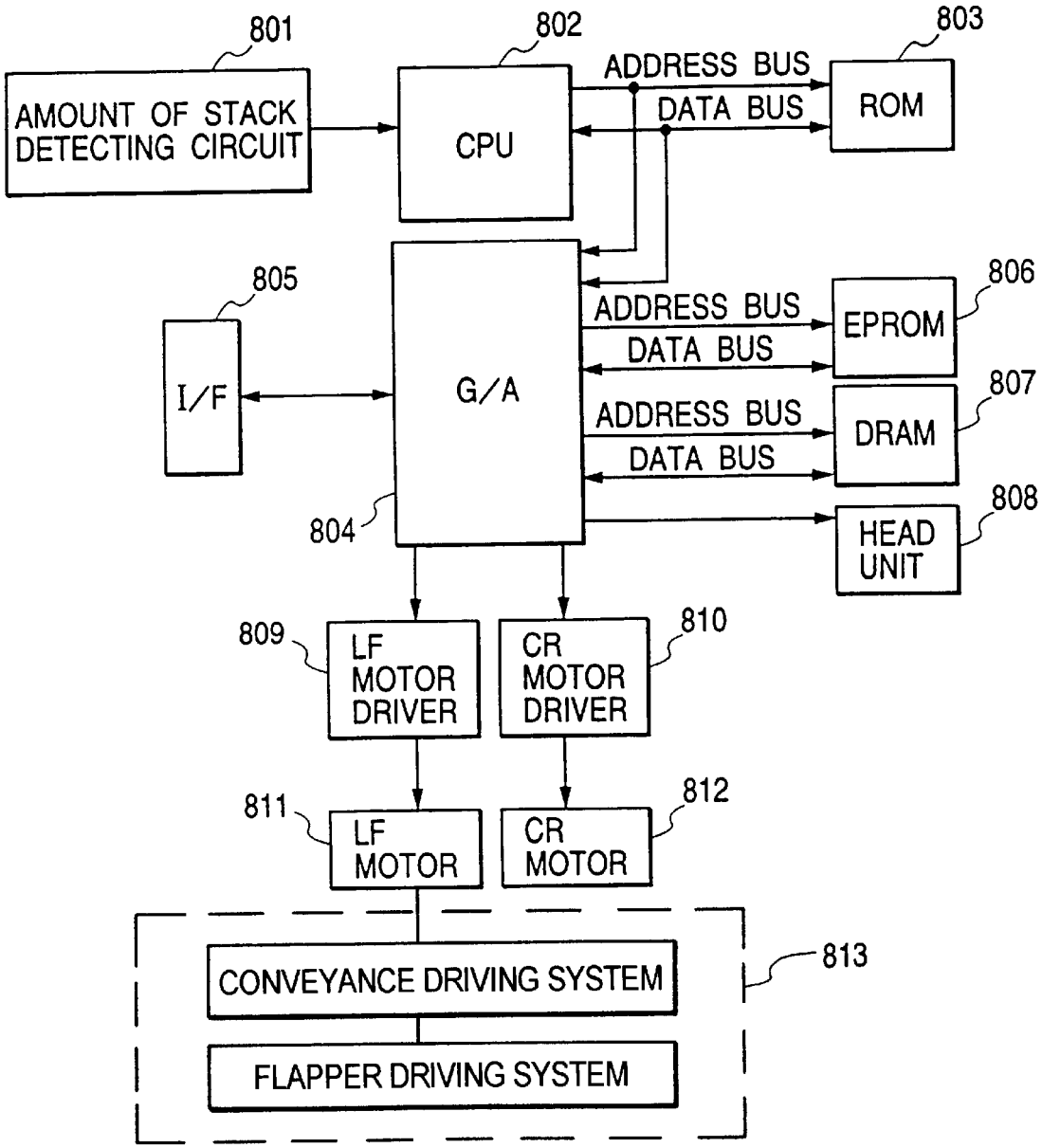
FIG. 5 is a block diagram explaining the structure of controlling the image recording apparatus according to the embodiment of the present invention.

FIG. 5 illustrates the structure of the control portion.

A CPU 802 is connected through a bus to a gate array (G/A) 804, a ROM 803, an EPROM 806, and a DRAM 807.

Here, the ROM 803 is a memory which stores a program for controlling the presumption of the dischargeable residual number of sheets from the distance from the upper surface of the stacked recording material to the upper portion of the flapper.

The DRAM 807 is a memory for temporarily storing data necessary for the control.

The EPROM 806 is a memory which can store information (paper thickness and the like) with regard to the individual kinds of paper to be newly registered.

An amount of stack detecting circuit 801 composed of the distance detecting circuit 7 and the calculation circuit 8 transmits the result of calculation carried out here to the CPU 802 for comparison and calculation.

An interface (I/F) 805 is provided for transmitting data to and receiving data from the side of the host and is connected to the gate array 804.

The gate array 804 is connected to a head unit (recording means) 808 for controlling the operation of the recording apparatus, a carriage motor driver (CR motor driver) 810, and a line feed motor driver (LF motor driver) 809. The carriage motor driver 810 and the line feed motor driver 809 are connected to a carriage motor (CR motor) 812 and a line feed motor (LF motor) 811, respectively.

Since the above-mentioned structure can always monitor the amount of stack of the discharged recording material, the state where sufficient amount of the recording material can be stacked can be always maintained by generating a warning from the printer driver or the like to urge the user toward removal or to refrain from carrying out the paper feed operation, or the like when the dischargeable residual number of sheets becomes small.

In particular, in case of a network printer, since it is often located away from the host which gave a printing command, conventionally, when the amount of stack exceeds the predetermined value, not only the operation of the flapper is hindered, the recording material is damaged, or the recording apparatus body is affected, but also the apparatus may be obliged to be initialized and may give others trouble. However, in the embodiment of the present invention, since a warning is generated when the dischargeable residual number of sheets still has sufficient room, if the user disposes appropriately, such a situation can be avoided.

Further, as described in the above, it is also possible to specify the accurate residual number of sheets by comparing the thickness data per sheet with the data of the dischargeable residual number of sheets with regard to the individual kinds of the recording material designated by the printer driver.

Still further, as described in the above, it is also possible, when the number of sheets established by the printer driver at present is larger than the presumed number of sheets, to indicate a warning or to carry out reduction printing within the range of the residual number of sheets to complete the recording operation.

Accordingly, the situation is avoided where the movable range of the flapper is narrowed and gradually cease to function, and the situation is avoided where the flapper comes in contact with the stacked recording material to damage or degrade the recorded image or to adversely affect the driving system for driving the flapper.

In particular, even when the driving source 813 for driving the flapper serves also as the driving source for conveying the recording material, that is, even when the flapper driving system branches off from the conveyance driving for conveying the recording material, these driving systems are not adversely affected, and thus, the possibility that improper discharge is caused due to the hindrance to the conveyance system is decreased.

[Embodiment 2]

FIGS. 6A, 6B, 7A, and 7B show a second embodiment. While, in the above first embodiment, a structure is shown which senses the amount of stack and presumes the residual amount by measuring the distance to the uppermost stacked recording material, in the present embodiment, a structure is shown which presumes the residual amount by sensing the rotational angle of a member which rotates according to the amount of stack.

Since the present embodiment is identical with the first embodiment with regard to other structures and actions, description of the identical components is omitted.

FIGS. 6A, 6B, 7A, and 7B are explanatory views of the operation of a discharge portion for a recording material in an image recording apparatus according to the second embodiment of the present invention (front views of a flapper and explanatory views corresponding to a mechanism portion for measuring a dischargeable residual amount of the recording material).

Figure 6A:
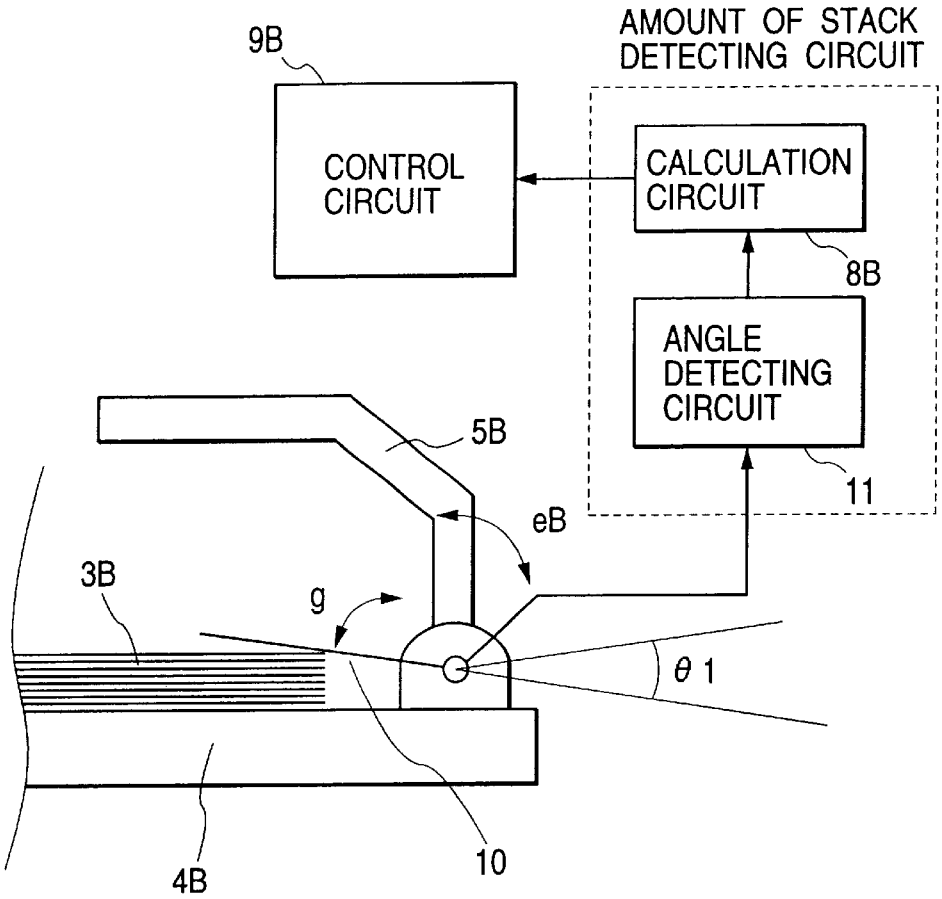
FIGS. 6A and 6B are explanatory views of the operation of a discharge portion for a recording material in an image recording apparatus according to a second embodiment of the present invention.
Figure 6B:
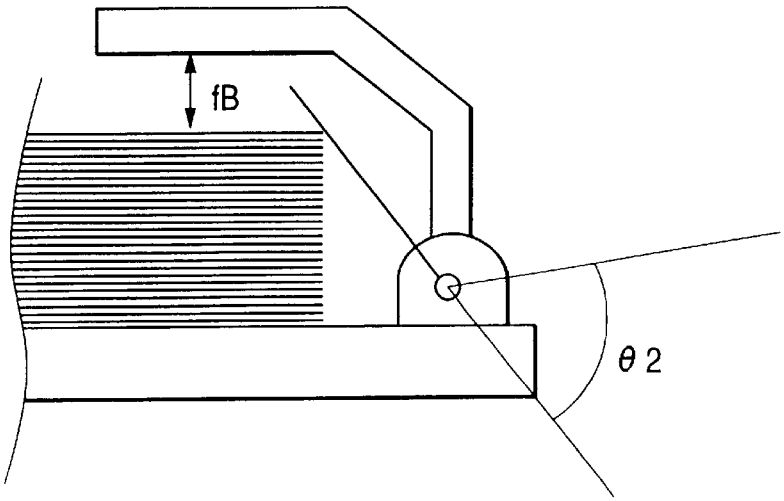

In FIGS. 6A and 6B, reference numerals 3B, 4B, and 5B denote a recording material, a sheet discharge tray as a discharge tray, and a flapper as an auxiliary retaining member, respectively. Similarly to the cases of the above descriptions, the flapper 5B is movable in the direction indicated by an arrow eB in FIG. 6A.

A height detection bar 10 as the rotating member used for measuring the height of the amount of stack is provided preferably coaxial with the rotation axis of the flapper 5B. By the power of a motor for conveying the recording material or the like and transmission means such as a gear which are not shown, the height detection bar 10 can be individually rotated regardless of the operation of the flapper 5B.

An angle detecting circuit 11 as a detecting member and a calculation circuit 8B together function as an amount of stack detecting circuit. A control circuit 9B of the image recording apparatus functions as presuming means for presuming the residual amount.

In the present embodiment, the height detection bar 10 as means for detecting the amount of stack of the recording material is operated in a direction indicated by an arrow g to incline to the side of the stacked object. The amount of stack and the dischargeable residual number of sheets are presumed from the angle formed by the height detection bar 10 with the horizontal line.

First, when the recording operation is carried out, the height detection bar 10 is inclined to the side of the stacked object. An angle θp formed by the height detection bar 10 with the horizontal line is detected by an angle sensor or the like which is not shown, and taken in by the angle detecting circuit 11. After the calculation circuit 8B carries out comparison and calculation, the distance fB is calculated and is transmitted to the control circuit 9B.

Figure 7A:
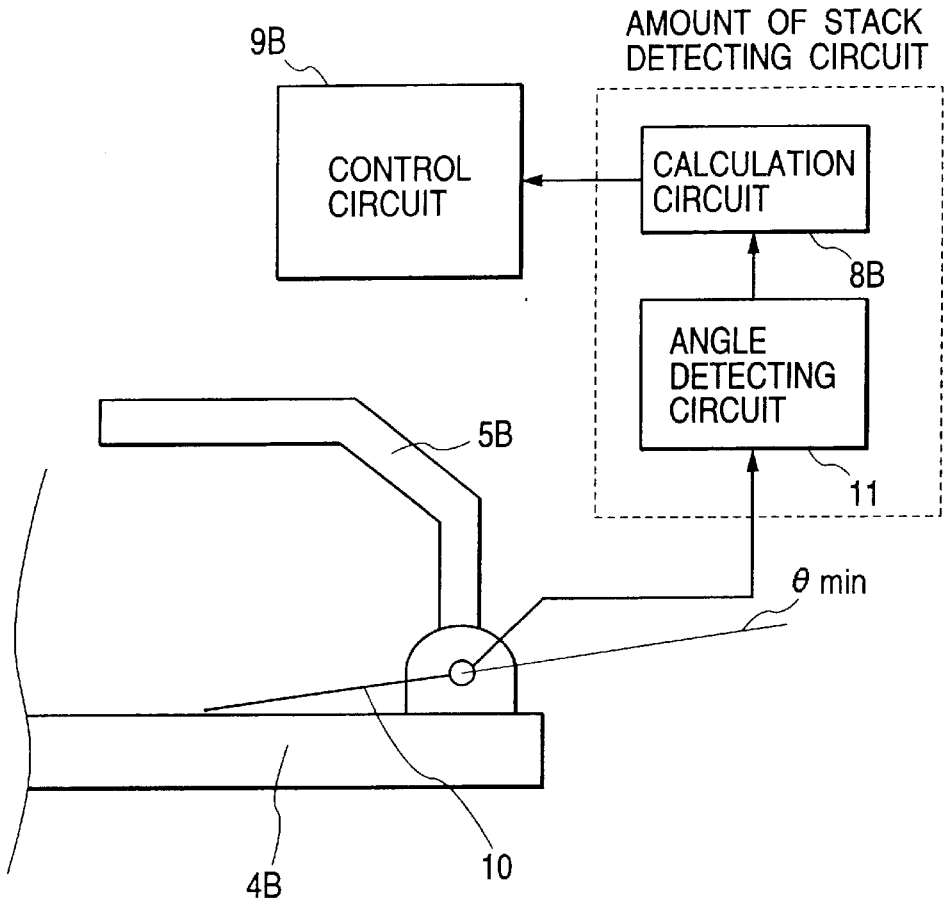
FIGS. 7A and 7B are explanatory views of the operation of the discharge portion for the recording material in the image recording apparatus according to the second embodiment of the present invention.
Figure 7B:
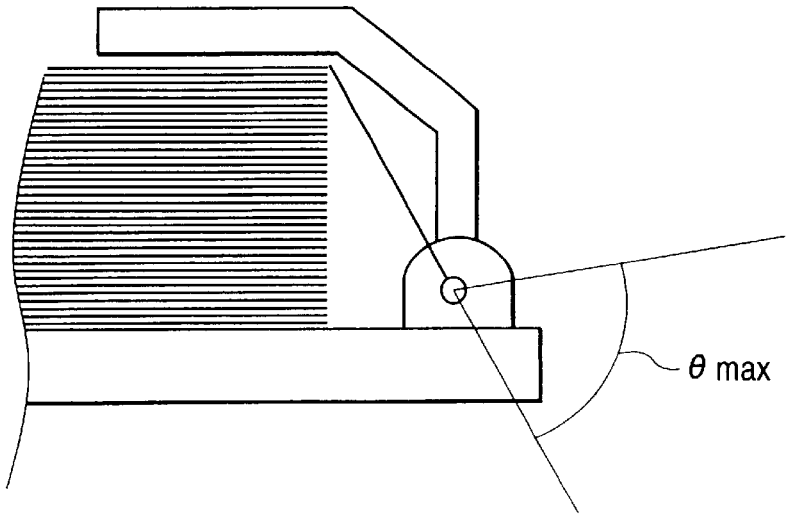

FIGS. 6A and 6B illustrate cases where the amount of stack of the recording material is small and large, respectively. In FIG. 6A where the amount of stack is small, the angle is θ1, while, in FIG. 6B where the amount of stack is large, the angle is θ2. FIGS. 7A and 7B illustrate cases where the amount of stack is zero and the maximum, respectively. In FIG. 7A where the amount of stack on the discharge tray is zero, the angle is θ min. When this angle is selected as a fiducial point of the angle detection, θ min is set to be zero. In FIG. 7B where the amount of stack is the maximum, the angle is θ max. The angles described here have the following relationship:

$$\theta\ \min < \theta 1 < \theta 2 < \theta\ \max,$$

and $$\theta\ \min < \theta p < \theta\ \max.$$

A memory device in the control circuit 9B stores in advance thickness data with regard to the recording material and the like. Of course, data stored in the memory device include the relationship between the angle Op of the height detection bar 10 and the amount of stack. Based on these data, by a method similar to that of the above first embodiment, the allowable residual number of sheets of stack, that is, the dischargeable residual number, can be presumed.

The structure described in the above can obtain similar effects to those of the above first embodiment.

[Embodiment 3]

Figure 8:
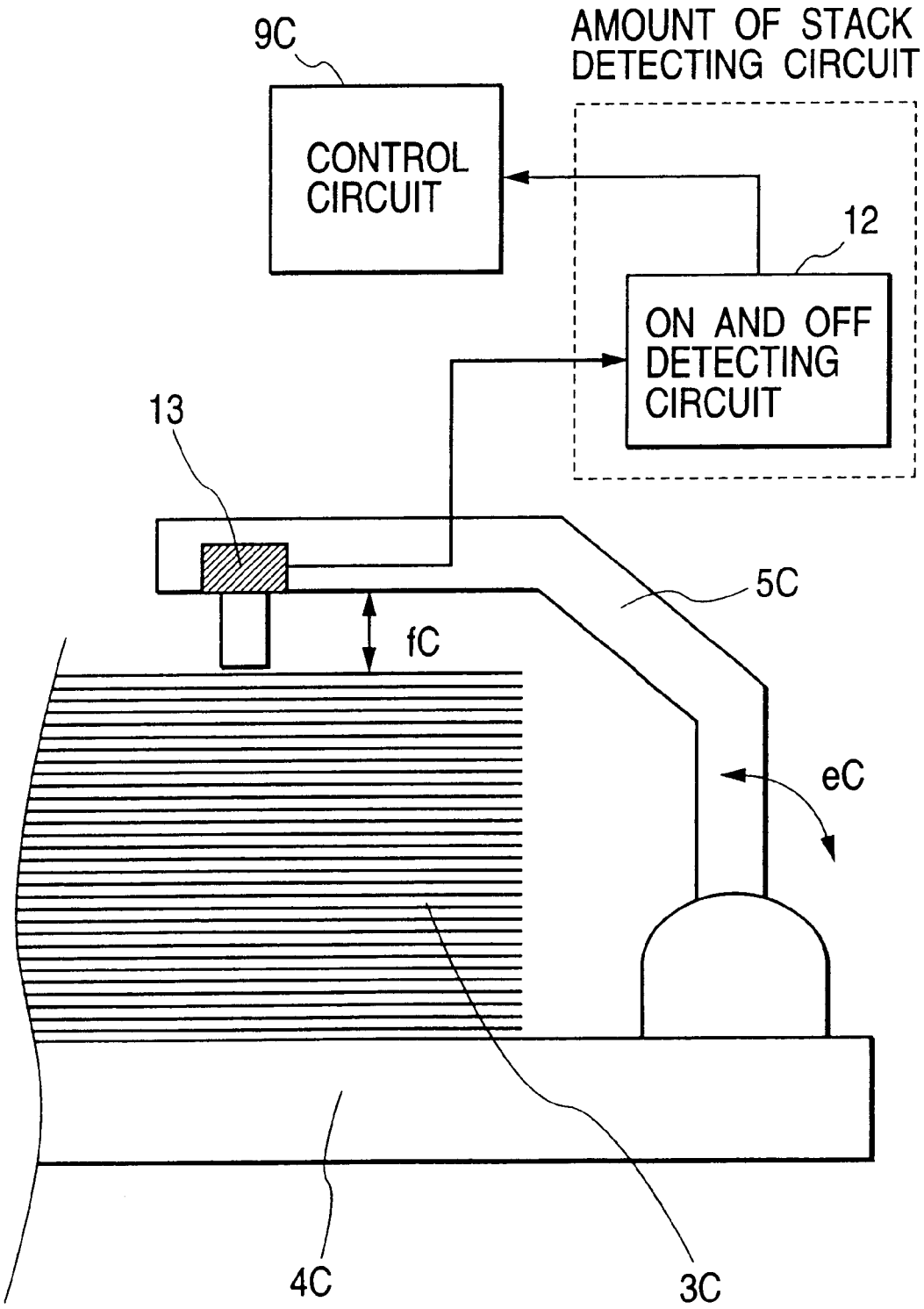
FIG. 8 is an explanatory view of the operation of a discharge portion for a recording material in an image recording apparatus according to a third embodiment of the present invention.
Figure 9:
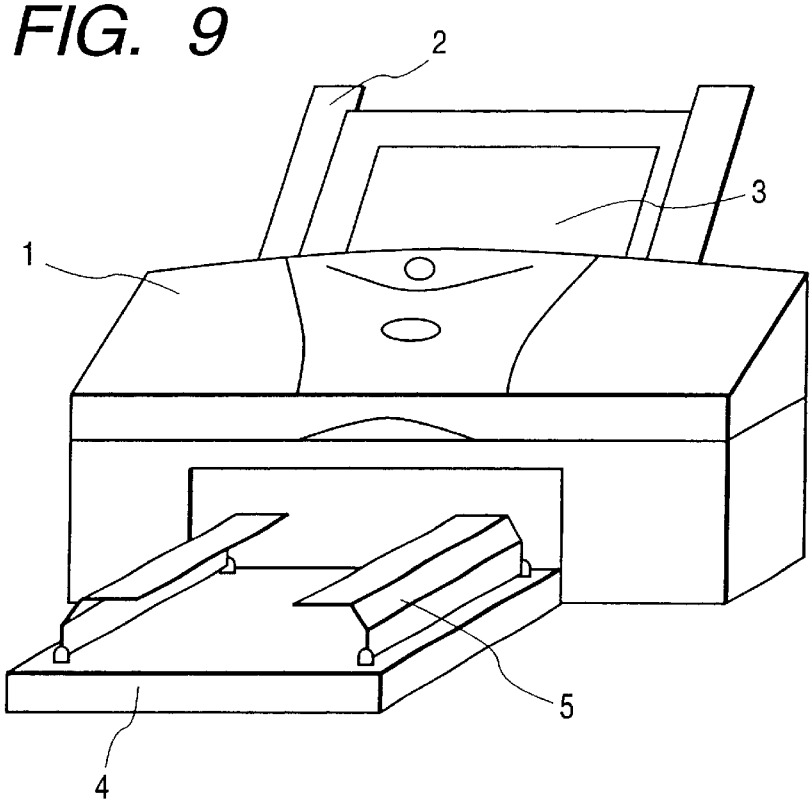
FIG. 9 is a schematic perspective view of an image recording apparatus according to the conventional art.

FIG. 8 shows a third embodiment. While, in the above embodiments, structures are shown which sense the amount of stack of the recording material regardless of the amount, in the present embodiment, a structure is shown which senses only whether the amount of stack reaches a predetermined amount or not.

Since the present embodiment is identical with the first embodiment with regard to other structures and actions, description of the identical components is omitted.

FIG. 8 is an explanatory view of the operation of a discharge portion for a recording material in an image recording apparatus according to a third embodiment of the present invention (a front view of a flapper and an explanatory view corresponding to a mechanism portion for measuring a dischargeable residual amount of the recording material).

In FIG. 8, reference numerals 3C, 4C, and 5C denote a recording material, a sheet discharge tray as a discharge tray, and a flapper as an auxiliary retaining member, respectively. Similarly to the cases of the above descriptions, the flapper 5C is movable in the direction indicated by an arrow eC in the figure.

A push-button switch 13 used for measuring that the amount of stack reaches a predetermined value is provided at an upper portion of the flapper 5C.

An ON and OFF detecting circuit (switch output detecting circuit) 12 functions as the amount of stack detecting circuit described in the above first and second embodiments. Reference numeral 9C denotes a control circuit of the image recording apparatus.

In the present embodiment, in order to detect the amount of stack of the recording material more easily than in the cases of the above embodiments, the time when the stacked object reaches a predetermined value is detected by a signal outputted by the push-button switch 13 and the distance fC between the flapper 5C and the upper surface of the stacked object is presumed.

In this method, since only whether the switch is turned ON or OFF needs to be judged, there are fewer additional circuits, which makes it possible to lower cost.

It is to be noted that, in the present embodiment also, at the time when the distance fC is presumed, similar effects can be obtained by similar means to those in the above embodiments. As described in the above, according to the present invention, by providing detecting means for detecting the amount of stack of a recording material on a discharge tray, stacking too much recording material on the discharge tray can be prevented, image degradation and the like due to stacking too much can be prevented, and excellent quality can be obtained.

What is claimed is:

1. An image recording apparatus for recording an image on a recording material by use of recording means for recording the image on the recording material, said apparatus comprising:

an auxiliary retaining member for temporarily retaining the recording material after the image is recorded thereon by said recording means and for dropping the recording material onto a discharge tray to stack the recording material; and detecting means for detecting an amount of a stack of the recording material on said discharge tray, wherein said detecting means includes a sensor for measuring a distance from a predetermined position to an uppermost surface of the stack of the recording material, and said sensor is provided on said auxiliary retaining member.

2. An image recording apparatus according to claim 1, wherein said detecting means detects whether the amount of the stack of the recording material on said discharge tray reaches a predetermined amount.

3. An image recording apparatus according to claim 2, wherein said detecting means comprises a switch, which comes in contact with the uppermost surface of the stack of the recording material when the amount of the stack of the recording material reaches the predetermined amount.

4. An image recording apparatus according to any one of claims 1, 2 and 3, wherein a result of a detection by said detecting means is transmitted to a control portion of a main body of said apparatus or to an external device.

5. An image recording apparatus according to any one of claims 1, 2, and 3, wherein a result of a detection by said detecting means is indicated on an indicating portion of a main body of said apparatus or on an indicating portion of an external device.

6. An image recording apparatus according to any one of claims 1, 2, and 3, further comprising presuming means for presuming, based on the amount of the stack of the recording material detected by said detecting means, an allowable residual amount of the stack of the recording material relative to a maximum amount of the stack of the recording material that will not hinder an operation of said auxiliary retaining member.

7. An image recording apparatus according to claim 6, wherein said presuming means also presumes an allowable residual number of sheets in said discharge tray by comparing a thickness of the recording material on which the image is recorded and the allowable residual amount of the stack of the recording material.

8. An image recording apparatus according to claim 7, wherein the thickness of the recording material is based on information registered in advance according to a kind of the recording material.

9. An image recording apparatus according to claim 6, wherein a result of a presumption by said presuming means is indicated on an indicating portion of a main body of said apparatus or on an indicating portion of an external device.

10. An image recording apparatus according to claim 6, wherein an image recording operation is not carried out when it is judged that there is no allowable residual amount of the stack of the recording material as a result of a presumption by said presuming means.

11. An image recording apparatus according to any one of claims 1, 2, and 3, wherein said auxiliary retaining member comprises opening and closing members provided at both ends, respectively, of said discharge tray in a width direction so as to be openable and closeable, and retains the recording material with said opening and closing members in a closed state and drops the recording material onto said discharge tray by opening said opening and closing members.

12. An image recording apparatus according to claim 11, wherein a retaining surface where the recording material is retained by said opening and closing members is substantially flush with a discharging surface of said discharging tray where the recording material after image recording thereon is discharged.

13. An image recording apparatus according to claim 11, wherein a driving source for opening and closing said opening and closing members serves as a driving source for conveying the recording material.

14. An image recording apparatus according to any one of claims 1, 2, and 3, wherein a time period for which the recording material after image recording thereon is temporarily retained by said auxiliary retaining member is established such that a degradation of a recorded image does not occur between a dropped recording material and the uppermost surface of the stack of the recording material.

15. An image recording apparatus for recording an image on a recording material by use of recording means for recording the image on the recording material, said image recording apparatus comprising:

an auxiliary retaining member for temporarily retaining the recording material after the image is recorded thereon by said recording means and for dropping the recording material onto a discharge tray to stack the recording material;

detecting means for detecting an amount of a stack of the recording material on said discharge tray, said detecting means being provided on said auxiliary retaining member; and presuming means for presuming, based on the amount of the stack of the recording material detected by said detecting means, an allowable residual amount of the stack relative to a maximum amount of the stack of the recording material that will not hinder an operation of said auxiliary retaining member, wherein said presuming means also presumes an allowable residual number of sheets of the stack by comparing a thickness of the recording material on which the image is recorded and the allowable residual amount of the stack of the recording material.

16. An image recording apparatus according to claim 15, wherein said detecting means comprises a sensor for measuring a distance from a predetermined position to an uppermost surface of the stack of the recording material.

17. An image recording apparatus according to claim 15, wherein the thickness of the recording material is based on information registered in advance according to a kind of the recording material.

18. An image recording apparatus according to claim 15, wherein a result of a presumption by said presuming means is indicated on an indicating portion of a main body of said apparatus or on an indicating portion of an external device.

19. An image recording apparatus according to claim 15, wherein an image recording operation is not carried out when it is judged that there is no allowable residual amount of the stack of the recording material as a result of a presumption by said presuming means.

20. An image recording apparatus according to claim 15, wherein said auxiliary retaining member comprises opening and closing members provided at both ends, respectively, of said discharge tray in a width direction so as to be openable and closeable, and retains the recording material with said opening and closing members in a closed state and drops the recording material onto said discharge tray by opening said opening and closing members.

21. An image recording apparatus according to claim 20, wherein a retaining surface where the recording material is retained by said opening and closing members is substantially flush with a discharging surface of said discharge tray where the recording material after image recording thereon is discharged.

22. An image recording apparatus according to claim 20, wherein a driving source for opening and closing said opening and closing members also serves as a driving source for conveying the recording material.

23. An image recording apparatus according to claim 15, wherein a time period for which the recording material after image recording thereon is temporarily retained by said auxiliary retaining member is established such that a degradation of a recorded image does not occur between a dropped recording material and an uppermost surface of the stack of the recording material.

* * * * *